US012662291B2

(12) United States Patent
Piech

(10) Patent No.: US 12,662,291 B2
(45) Date of Patent: Jun. 23, 2026

(54) CAN END

(71) Applicant: Top Cap Holding GmbH, Kufstein (AT)

(72) Inventor: Gregor Anton Piech, Scheffau am Wilden Kaiser (AT)

(73) Assignee: TOP CAP HOLDING GMBH, Kufstein (AT)

( * ) Notice: Subject to any disclaimer, the term of this patent is extended or adjusted under 35 U.S.C. 154(b) by 46 days.

(21) Appl. No.: 18/705,808

(22) PCT Filed: Oct. 31, 2023

(86) PCT No.: PCT/EP2023/080332
§ 371 (c)(1),
(2) Date: Apr. 29, 2024

(87) PCT Pub. No.: WO2024/094680
PCT Pub. Date: May 10, 2024

(65) Prior Publication Data

US 2025/0333211 A1 Oct. 30, 2025

(30) Foreign Application Priority Data

Nov. 4, 2022 (DE) ..... 102022129193.6

(51) Int. Cl.
*B65D 41/16* (2006.01)

(52) U.S. Cl.
CPC .... *B65D 41/165* (2013.01); *B65D 2517/0002* (2013.01); *B65D 2517/0031* (2013.01); *B65D 2517/0058* (2013.01)

(58) Field of Classification Search
CPC .... B65D 41/165; B65D 41/16; B65D 43/162; B65D 43/16; B65D 2517/0002;
(Continued)

(56) References Cited

U.S. PATENT DOCUMENTS 3,127,064 A * 3/1964 Fairchild ..... B65D 47/0838 220/837
4,519,517 A * 5/1985 Walter ..... B65D 55/02 220/837

(Continued)

FOREIGN PATENT DOCUMENTS

CA 3030445 A1 * 1/2018 ..... B65D 17/404
CN 106458363 A 2/2017

(Continued)

OTHER PUBLICATIONS

German Patent and Trademark Office. Search Report for DE Application No. 102022129193.6 and English translation, mailed Jul. 10, 2023, pp. 1-12.

(Continued)

*Primary Examiner* — Robert J Hicks
(74) *Attorney, Agent, or Firm* — Vivacqua Crane, PLLC

(57) ABSTRACT

A can end having a metallic end surface in which an opening is formed that is bounded by a closed margin of the end surface and that can be closed by a closure piece is provided. The can end has a sealing frame and a closure unit that supports the closure piece and that is pivotably attached to the metallic end surface. The sealing frame and the closure unit can be releasably connected in a fluidtight manner to one another via a sealing rib and an associated reception groove. Respective latching lugs are arranged at the one sealing rib and at the reception groove. In a starting position of the closure unit, the closure piece is flush with the surrounding end surface or is offset in parallel therefrom by less than the thickness of the metallic end surface.

15 Claims, 6 Drawing Sheets

(58) Field of Classification Search
CPC .... B65D 2517/0031; B65D 2517/0001; B65D 2517/0058; B65D 2251/105; B65D 2543/00916
USPC ..... 220/283, 282, 281, 260, 826, 837, 836, 220/810
See application file for complete search history.

(56) References Cited

U.S. PATENT DOCUMENTS

| | | | |
|---|---|---|---|
| 7,556,168 | B2 | 7/2009 | Turner et al. |
| 11,878,835 | B2 | 1/2024 | Piech |
| 2018/0016058 | A1 | 1/2018 | Thielen et al. |

FOREIGN PATENT DOCUMENTS

| | | | | |
|---|---|---|---|---|
| CN | 109071067 | A | 12/2018 | |
| CN | 111498242 | A | 8/2020 | |
| DE | 1482529 | A1 | 1/1969 | |
| DE | 102006001323 | A1 | 7/2007 | |
| EP | 2354022 | A1 | 8/2011 | |
| EP | 3385184 | A1 * | 10/2018 | ..... B65D 17/404 |
| EP | 3385185 | B1 | 10/2018 | |
| FR | 1028155 | A | 5/1953 | |
| TW | 201028341 | A | 8/2010 | |
| TW | I439396 | B | 6/2014 | |
| TW | M558764 | U | 4/2018 | |
| TW | I729413 | B | 6/2021 | |
| WO | 2015067075 | A1 | 5/2015 | |
| WO | 2017016686 | A1 | 2/2017 | |
| WO | 2018184703 | A1 | 10/2018 | |
| WO | 2018184704 | A1 | 10/2018 | |
| WO | 2022090310 | A1 | 5/2022 | |

OTHER PUBLICATIONS

International Searching Authority. International Search Report and Written Opinion for PCT Application No. PCT/EP2023/080335 and English translation, mailed Mar. 1, 2024, pp. 1-17.

* cited by examiner

CAN END

CROSS-REFERENCE TO RELATED APPLICATIONS

This application is a national stage application under 35 U.S.C. 371 of PCT Application No. PCT/EP2023/080332 having an international filing date of Oct. 31, 2023, which claims the benefit of German Patent Application No. 102022129193.6, filed Nov. 4, 2022, the entire disclosure of each of which are hereby incorporated herein by reference.

INTRODUCTION

The invention relates to a can end, in particular for beverage cans, having a metallic end surface in which an opening is formed that is bounded by a closed margin of the end surface and that can be closed by a closure piece of the metallic end surface, having a sealing frame composed of plastic material that is connected to the metallic end surface and that surrounds the opening, having a closure unit composed of plastic material that supports the closure piece and that is pivotably attached to the metallic end surface via a pivot bearing, wherein the sealing frame and the closure unit can be releasably connected in a fluidtight manner to one another via at least one sealing rib and an associated reception groove, wherein respective latching lugs are arranged at the at least one sealing rib and at the associated reception groove, the respective latching lugs running around the opening and engaging behind one another with respect to a vertical direction facing transversely to the plane defined by the opening, and wherein, in a starting position of the closure unit, the closure piece closing the opening is flush with the surrounding end surface or is offset in parallel therefrom by less than the thickness of the metallic end surface.

Can ends of this type are used on a large scale to manufacture beverage cans, food cans and the like. Due to the cooperation of the sealing rib and the reception groove, a corresponding can end can be closed again after the opening. Before the can end is opened for the first time, the closure piece can be separated from the surrounding end surface by a microgap or a weakening line extending at least sectionally along the margin of the end surface, wherein a sealing film composed of a plastic material and applied to the inner side of the can end can cover the microgap or the weakening line. After the first opening, the leak tightness of the can end can only be ensured via the sealing rib and the reception groove.

The pivot bearing can be formed directly between the closure unit and the metallic end surface, for example by connecting a flexible plastic strip to the closure unit at one end and to the metallic end surface at the other end. However, the pivot bearing can also be formed between the closure unit and the sealing frame, wherein there is also a pivot connection between the closure unit and the metallic end surface due to the fastening of the sealing frame to the metallic end surface.

It has been found that moving the closure piece out of the plane defined by the opening is not exactly reversible. Due to unavoidable deformations, it is difficult to fit the closure piece into the opening again when reclosing the can end. Pressing the closure piece into the opening requires an undesirably high amount of force here. In certain application situations, it could even happen that the closure piece abuts the margin of the opening and the latching lugs no longer engage behind one another. The can end is then only inadequately sealed.

It is an object of the invention to enable an easier and more reliable reclosing of can ends of said kind.

The object is satisfied by a can end having the features of claim 1.

SUMMARY

According to the invention, the latching lug of the sealing frame and the latching lug of the closure unit are spaced apart from one another in the vertical direction by a predefined vertical offset when the closure unit is in the starting position.

Due to the vertical offset, there is some movement play for the latching lugs. This play enables a compensation of deformations and changes in position of the closure piece after the first opening of the can end. A latching engagement between the sealing frame and the closure unit is therefore possible even if the closure piece cannot be returned to its original position, e.g. the position flush with the surrounding end surface. The leak tightness and the firm closure of a can end according to the invention are thus ensured even after the first opening.

The latching lugs preferably extend around the opening without interruptions or with distributed interruptions so that a stable latching engagement is possible. It is further preferred that the vertical offset between the latching lugs exists at least substantially at each point of the course of the latching lugs since the shape and the position of the closure piece are generally undefined after the first opening of the can end.

According to one embodiment of the invention, the vertical offset is at least as large and preferably at least substantially as large as the thickness of the metallic end surface. Even if the closure piece regionally abuts the surrounding end surface, a latching engagement between the sealing frame and the closure unit is made possible in this embodiment.

A specific embodiment of the invention provides that the metallic end surface is laminated with a foil at an inner side opposite the sealing frame and the vertical offset is at least as large, and preferably at least substantially exactly as large, as the sum of the thickness of the metallic end surface and the thickness of the foil. This allows a latching engagement between the sealing frame and the closure unit even in the event that the closure piece abuts the upper side of the surrounding end surface with its lower-side foil.

According to a further embodiment of the invention, the vertical offset is at least 0.05 mm and at most 2 mm, preferably at least 0.2 mm and at most 1 mm, particularly preferably at least 0.35 mm and at most 0.55 mm. This has proven to be particularly favorable in practice.

The latching lugs are preferably formed by surface sections extending at least substantially in parallel with one another and/or obliquely to the plane defined by the opening.

The metallic end surface can be made of aluminum.

The sealing frame and the closure unit may have respective abutment surfaces that contact one another when the closure unit is in the starting position. In this embodiment, the movement play for the closure unit in the vertical direction is limited, on the one hand, by the abutment surfaces and, on the other hand, by the latching lugs engaging behind one another.

The invention also relates to a can end, in particular for beverage cans, having a metallic end surface in which an opening is formed that is bounded by a closed margin of the end surface and that can be closed by a closure piece of the metallic end surface, having a sealing frame composed of plastic material that is connected to the metallic end surface and that surrounds the opening, having a closure unit composed of plastic material that supports the closure piece and that is pivotably attached to the metallic end surface via a pivot bearing, wherein the sealing frame and the closure unit can be releasably connected in a fluidtight manner to one another via at least one sealing rib and an associated reception groove, wherein respective latching lugs are arranged at the at least one sealing rib and at the associated reception groove, the respective latching lugs running around the opening and engaging behind one another with respect to a vertical direction facing transversely to the plane defined by the opening.

According to the invention, the latching lugs extend around the opening with distributed interruptions. This results in stiffening webs that increase the stability of the latching connection. The interruptions are preferably uniformly distributed along the periphery of the opening.

Further developments of the invention can also be seen from the dependent claims, from the following description, and from the enclosed drawing.

BRIEF DESCRIPTION OF THE DRAWINGS

The invention will be described in the following by way of example with reference to the drawing.

DETAILED DESCRIPTION

Figure 1:
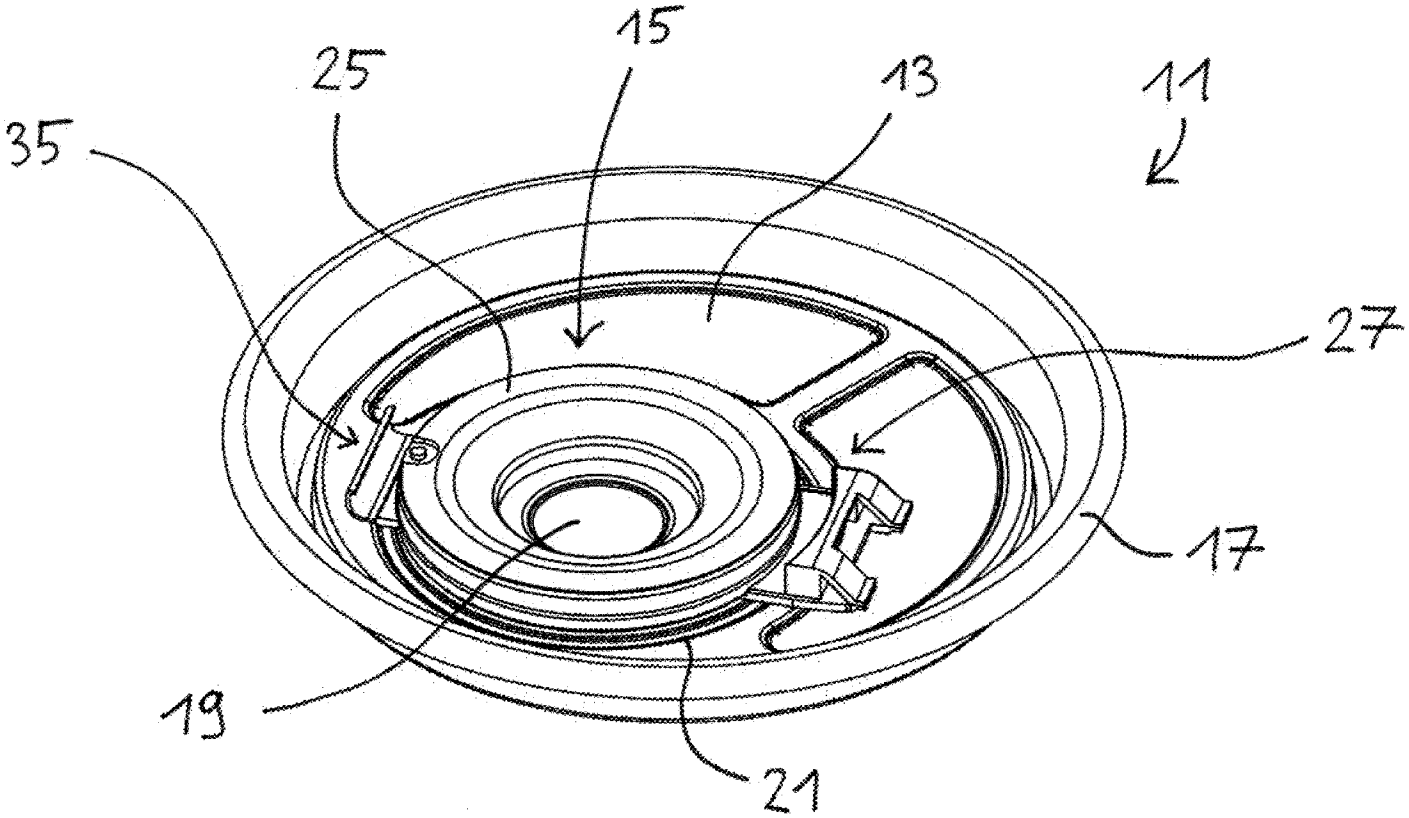
FIG. 1 is a perspective part representation of a can end according to the invention.
Figure 2:
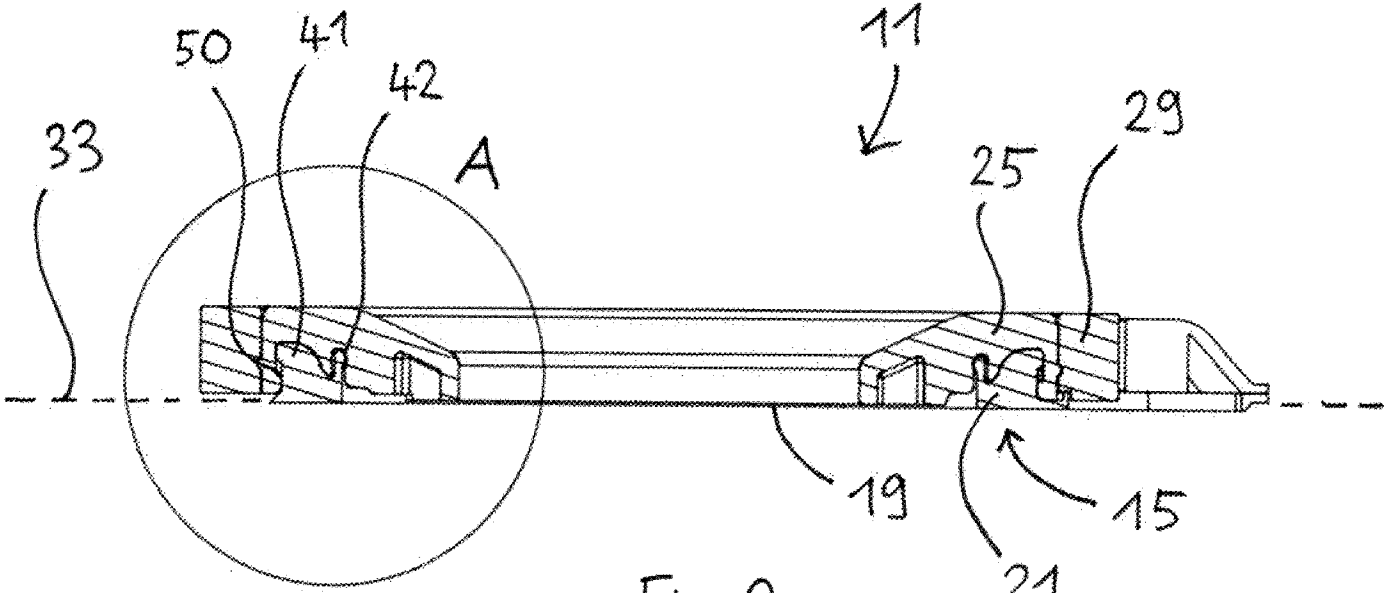
FIG. 2 shows the can end according to FIG. 1 in a sectional view before the first opening.

FIGS. 1 and 2 show a can end 1 that is in particular intended for a beverage can and into whose metallic end surface 13 a reclosable opening system 15 is integrated. The can end 11 can be connected to an associated container, not shown, via a beaded rim 17. In the metallic end surface 13, an opening is provided that is closed by a section of the metallic end surface 13 in the form of a closure piece 19 in the delivery state of the can end 11 shown in FIGS. 1 and 2. The closure piece 19 is separated from the surrounding end surface 13 by a microgap or weakening line (not shown).

The metallic end surface 13 is preferably formed from a sheet metal layer of aluminum or tin plate. A sealing film composed of plastic can be applied to the inner side of the can end 11, which is not shown in the Figures, however.

The reclosable opening system 15 comprises a sealing frame 21 composed of plastic material that surrounds the opening and that is fixedly connected to the surrounding end surface 13. A closure unit 25 composed of a plastic material is further provided that supports the closure piece 19 and that is attached to the sealing frame 21 via a first pivot bearing 27 and is thus pivotably attached to the surrounding end surface 13.

An annular tear-open member 29 (FIG. 2), preferably likewise composed of plastic, is connected to or directly molded to the closure unit 25 and is accordingly fastened to the closure piece 19. By pulling at the tear-open member 29, a user can pivot the closure piece 19 upwardly out of the opening plane 33 defined by the opening and can thus release the opening, possibly while separating the sealing film. The connection between the tear-open member 29 and the closure unit 25 is provided by a second pivot bearing 35 (FIG. 1) that is disposed diametrically opposite the first pivot bearing 27. For a better overview, the tear-open member 29 is omitted in FIG. 1.

Figure 3:
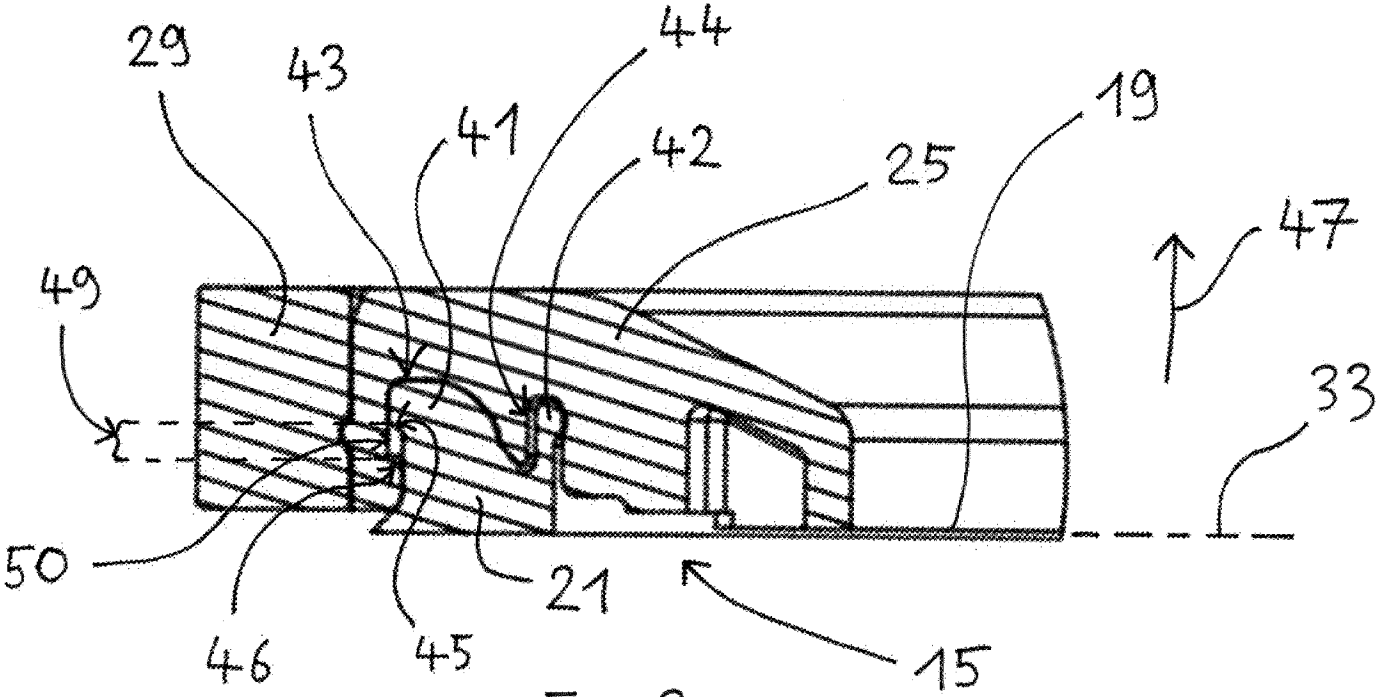
FIG. 3 is the enlarged section A from FIG. 2.

As can also be seen from the enlarged detailed representation of FIG. 3, a radially outer sealing rib 41 and a radially inner sealing rib 42 are formed at the sealing frame 21. Furthermore, a radially outer reception groove 43 and a radially inner reception groove 44 are formed at the closure unit 25. The sealing ribs 41, 42 and reception grooves 43, 44 engaging into one another enable a releasable fluid-tight connection between the sealing frame 21 and the closure unit 25. The can end 11 is therefore reclosable. It is understood that the sealing ribs 41, 42 could also be arranged at the closure unit 25 and the reception grooves 43, 44 could also be arranged at the sealing frame 21. Depending on the application requirements, more than two pairs of sealing ribs 41, 42 and reception grooves 43, 44 could also be provided.

At the radially outer sealing rib 41 and at the radially outer reception groove 43, respective latching lugs 45, 46 are formed in the form of slanted surfaces that engage behind one another with respect to a vertical direction 47 facing transversely to the opening plane 33. The latching lug 45 of the sealing frame 21 and the latching lug 46 of the closure unit 25 extend in parallel with one another and extend around the entire opening.

FIG. 3 shows the reclosable opening system 15 and in particular the closure unit 25 in a starting position that is present before the first opening. In the starting position, the closure piece 19 is flush with the surrounding end surface 13 (FIG. 1). That is, the closure piece 19 extends in the opening plane 33. Furthermore, as can be seen in FIG. 3, the sealing ribs 41, 42 contact the base of the reception grooves 43, 44 when the closure unit 25 is in the starting position.

However, the latching lug 45 of the sealing frame 21 does not contact the latching lug 46 of the closure unit 25 when the closure unit 25 is in the starting position. Rather, the latching lugs 45, 46 are spaced apart from one another in the vertical direction 47 by a predefined vertical offset 49 so that there is a free space 50 between the latching lugs 45, 46. The vertical offset 49 is preferably selected to be as large as the thickness of the metallic end surface 13 plus the thickness of any foil. Specifically, the vertical offset 49 can be at least 0.35 mm and at most 0.55 mm.

On the first opening of the can, a user pulls at the tear-open member 29 and thereby upwardly pivots the closure unit 25 out of the opening plane 33 with the closure piece 19. In this respect, the latching connection between the closure unit 25 and the sealing frame 21 is released and the closure piece 19 is lifted off the end surface 13. The contents of the can be removed through the opening produced. When the closure unit 25 with the closure piece 19 is pivoted back again, the latching connection between the closure unit 25 and the sealing frame 21 is reestablished such that the opening is sealed tightly again. The opening and closing procedure can then be repeated as often as desired.

Figure 4:
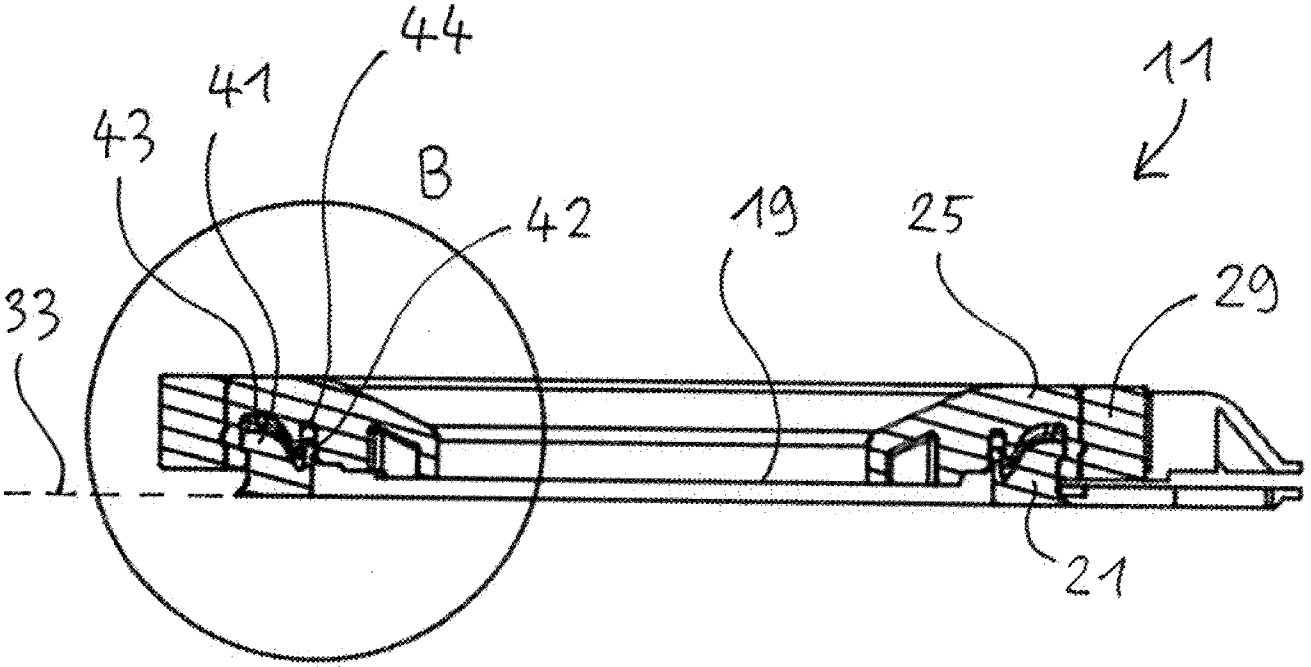
FIG. 4 shows the can end according to FIG. 1 in a sectional view after the first opening in a reclosed state.
Figure 5:
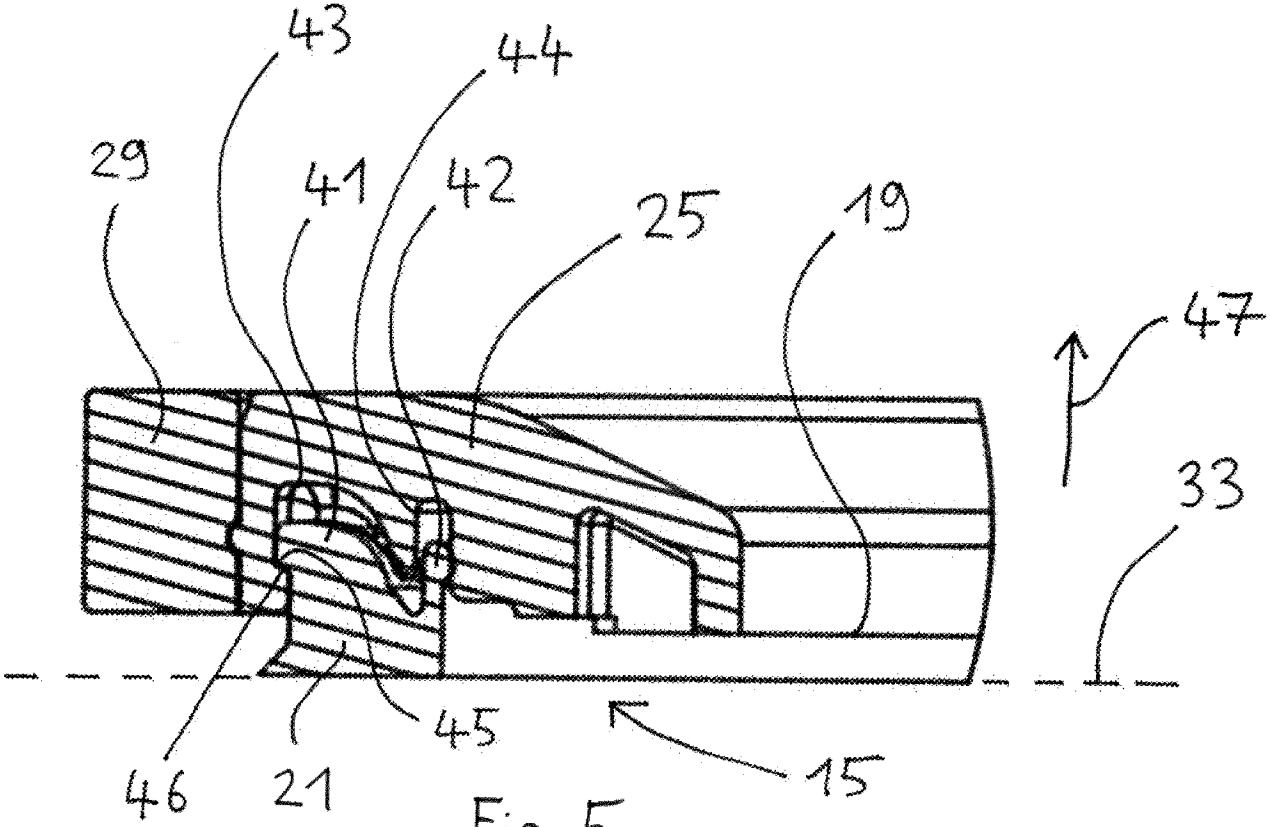
FIG. 5 is the enlarged section B from FIG. 4.

FIG. 4 and FIG. 5 show the reclosable opening system 15 in a reclosed state after the first opening. Due to unavoidable deformations and changes in position, it is generally not possible to fit the closure piece 19 exactly into the opening again and thus to restore the areally flush starting state.

Rather, the closure piece 19 abuts the margin of the opening in places and thus remains slightly above the opening plane 33 viewed as a whole. However, due to the vertical offset 49 (FIG. 3) present in the starting position, there is sufficient movement play in the vertical direction 47 for the closure unit 25 so that the incorrect positioning of the closure piece 19 can be compensated. Despite the misplacement, the latching lugs 45, 46 can engage behind one another so that the sealing frame 21 and the closure unit 25 are reliably latched to one another even in the reclosed state. Leaks and an unintentional opening are therefore avoided with a can end 11 according to the invention.

Figure 6:
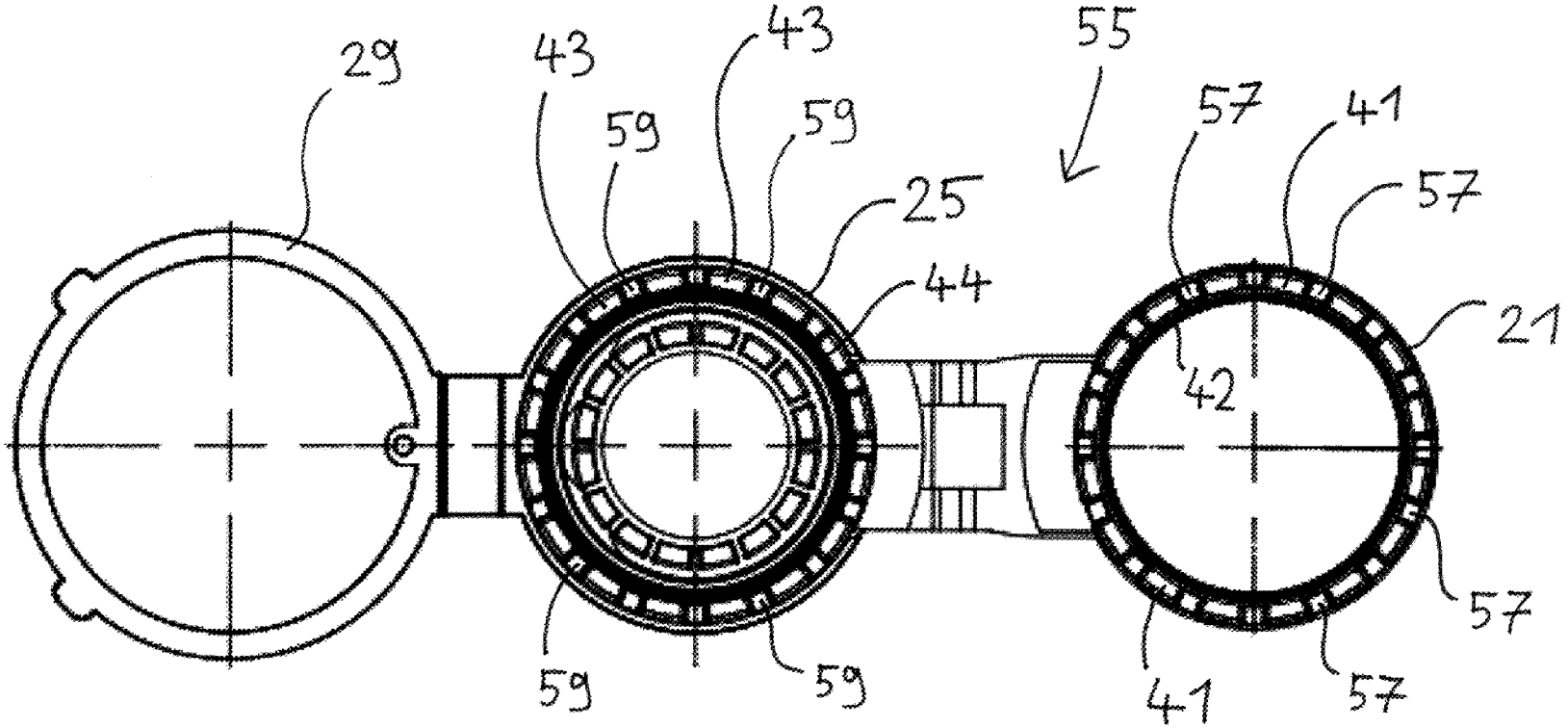
FIG. 6 is a plan view of a plastic part by which a sealing frame, a closure unit and a tear-open member of a can end according to the invention are formed.

FIG. 6 shows a single-piece plastic part 55 that comprises the sealing frame 21, the closure unit 25 and the tear-open member 29. It can be seen that the radially outer sealing rib 41 and the radially outer reception groove 43—including the latching lugs 45, 46 not visible in FIG. 6—are interrupted by recesses 57 and stiffening webs 59, respectively. That is, the radially outer sealing rib 41 extends around the opening with uniformly distributed interruptions in the form of recesses 57. Similarly, the radially outer reception groove 43 extends around the opening with uniformly distributed interruptions in the form of stiffening webs 59. The stiffening webs 59 fit into the recesses 57. This is advantageous in that an escape of material is counteracted and thus the latching engagement is provided to be more stable and reliable overall, yet completely peripheral around the opening. The latching lugs 45, 46 could, however, generally also extend around the opening without interruptions.

It is not necessary for the closure piece 19 be flush with the surrounding end surface 13 in the starting state. Rather, in the starting state, the closure piece 19 can be offset in parallel from the metallic end surface 13 transversely to the opening plane 33 by less than the sheet metal thickness, for example by at most 80% of the sheet metal thickness, to form a cutting edge for a better cutting through of the inner-side foil.

REFERENCE NUMERAL LIST

11 can end
13 metallic end surface
15 reclosable opening system
17 beaded rim
19 closure piece
21 sealing frame
25 closure unit
27 first pivot bearing
29 tear-open member
33 opening plane
35 second pivot bearing
41 radially outer sealing rib
42 radially inner sealing rib
43 radially outer reception groove
44 radially inner reception groove
45 latching lug of the sealing frame
46 latching lug of the closure unit
47 vertical direction
49 vertical offset
50 free space
55 plastic part
57 recess
59 stiffening web

The invention claimed is:

1. A can end:

having a metallic end surface in which an opening is formed that is bounded by a closed margin of the end surface and that can be closed by a closure piece of the metallic end surface, having a sealing frame composed of plastic material that is connected to the metallic end surface and that surrounds the opening, having a closure unit composed of plastic material that supports the closure piece and that is pivotably attached to the metallic end surface via a pivot bearing, wherein the sealing frame and the closure unit can be releasably connected in a fluidtight manner to one another via at least one sealing rib and an associated reception groove, wherein respective latching lugs are arranged at the at least one sealing rib and at the associated reception groove, the respective latching lugs running around the opening and engaging behind one another with respect to a vertical direction facing transversely to the plane defined by the opening, and wherein, in a starting position of the closure unit, the closure piece closing the opening is flush with the surrounding end surface or is offset in parallel therefrom by less than the thickness of the metallic end surface wherein the latching lug of the sealing rib and the latching lug of the reception groove are spaced apart from one another in the vertical direction by a predefined vertical offset when the closure unit is in the starting position.

2. The can end according to claim 1, wherein the latching lugs extend around the opening without interruptions or with distributed interruptions.

3. The can end according to claim 1, wherein the vertical offset is at least substantially exactly as large as the thickness of the metallic end surface.

4. The can end according to claim 3, wherein the vertical offset is at least substantially exactly as large as the thickness of the metallic end surface.

5. The can end according to claim 1, wherein the metallic end surface is laminated with a foil at an inner side opposite the sealing frame and the vertical offset is at least as large as the sum of the thickness of the metallic end surface and the thickness of the foil.

6. The can end according to claim 5, wherein the metallic end surface is laminated with a foil at an inner side opposite the sealing frame and the vertical offset is at least substantially exactly as large as the sum of the thickness of the metallic end surface and the thickness of the foil.

7. The can end according to claim 1, wherein the vertical offset is at least 0.05 mm and at most 2 mm.

8. The can end according to claim 7, wherein the vertical offset is at least 0.2 mm and at most 1 mm.

9. The can end according to claim 7, wherein the vertical offset is at least 0.35 mm and at most 0.55 mm.

10. The can end according to claim 1, wherein the latching lugs are formed by surface sections extending at least substantially in parallel with one another and/or obliquely to the plane defined by the opening.

11. The can end according to claim 1, wherein the metallic end surface is made of aluminum.

12. The can end according to claim 1, wherein the sealing frame and the closure unit have respective abutment surfaces that contact one another when the closure unit is in the starting position.

13. The can end according to claim 1, wherein the can end is configured for beverage cans.

14. A can end:

having a metallic end surface in which an opening is formed that is bounded by a closed margin of the end surface and that can be closed by a closure piece of the metallic end surface, having a sealing frame composed of plastic material that is connected to the metallic end surface and that surrounds the opening, having a closure unit composed of plastic material that supports the closure piece and that is pivotably attached to the metallic end surface via a pivot bearing, wherein the sealing frame and the closure unit can be releasably connected in a fluidtight manner to one another via at least one sealing rib and an associated reception groove, wherein respective latching lugs are arranged at the at least one sealing rib and at the associated reception groove, the respective latching lugs running around the opening and engaging behind one another with respect to a vertical direction facing transversely to the plane defined by the opening, wherein the latching lugs extend around the opening with distributed interruptions.

15. The can end of claim 14, wherein the can end is configured for beverage cans.

* * * * *